US009541850B2

(12) United States Patent
Nishida et al.

(10) Patent No.: US 9,541,850 B2
(45) Date of Patent: Jan. 10, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tsutomu Nishida, Mishima (JP); Masato Tanaka, Tagata-gun (JP); Masataka Kawahara, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/677,855

(22) Filed: Apr. 2, 2015

(65) Prior Publication Data

US 2015/0309426 A1 Oct. 29, 2015

(30) Foreign Application Priority Data

Apr. 25, 2014 (JP) ..... 2014-091821

(51) Int. Cl.
*G03G 5/00* (2006.01)
*G03G 5/06* (2006.01)
*G03G 5/05* (2006.01)

(52) U.S. Cl.
CPC ..... *G03G 5/0662* (2013.01); *G03G 5/0517* (2013.01); *G03G 5/0696* (2013.01)

(58) Field of Classification Search
CPC ..... G03G 5/0662; G03G 5/0696
USPC ..... 430/59.4
See application file for complete search history.

(56) References Cited

U.S. PATENT DOCUMENTS

| | | | | |
|---|---|---|---|---|
| 6,245,472 | B1 | 6/2001 | Tanaka | |
| 6,472,524 | B2 | 10/2002 | Tanaka | |
| 8,383,304 | B2 | 2/2013 | Yanagawa et al. | |
| 8,974,991 | B2 | 3/2015 | Kawahara et al. | |
| 2007/0259281 | A1* | 11/2007 | Lin | C07D 487/22 430/58.8 |
| 2014/0170540 | A1 | 6/2014 | Tanaka | |
| 2014/0170541 | A1 | 6/2014 | Tanaka | |
| 2014/0170542 | A1 | 6/2014 | Tanaka | |
| 2015/0093694 | A1 | 4/2015 | Watariguchi et al. | |

FOREIGN PATENT DOCUMENTS

| | | | |
|---|---|---|---|
| JP | 6-214414 | A | 8/1994 |
| JP | 2011-175088 | A | 9/2011 |
| JP | 2013-28699 | A | 2/2013 |

OTHER PUBLICATIONS

U.S. Appl. No. 14/740,941, filed Jun. 16, 2015. Inventor: Masato Tanaka, et al.
U.S. Appl. No. 14/689,341, filed Apr. 17, 2015. Inventor: Junpei Kuno, et al.

(Continued)

*Primary Examiner* — Mark A Chapman
(74) *Attorney, Agent, or Firm* — Fitzpatrick, Cella, Harper & Scinto

(57) ABSTRACT

A photosensitive layer includes a gallium phthalocyanine crystal and 0.2% by mass or more and 20% by mass or less of an arene compound based on the gallium phthalocyanine crystal, and the arene compound has a halogen atom or a halogen-substituted alkyl group, and a sulfonic acid group or a sulfonic acid salt group, as a substituent.

10 Claims, 4 Drawing Sheets

(56) References Cited

OTHER PUBLICATIONS

U.S. Appl. No. 14/721,307, filed May 26, 2015. Inventor: Masataka Kawahara, et al.
U.S. Appl. No. 14/722,985, filed May 27, 2015. Inventor: Masataka Kawahara, et al.
U.S. Appl. No. 14/730,482, filed Jun. 4, 2015. Inventor: Masato Tanaka, et al.
U.S. Appl. No. 14/689,364, filed Apr. 17, 2015. Inventor: Junpei Kuno, et al.
U.S. Appl. No. 14/680,040, filed Apr. 6, 2015. Inventor: Masato Tanaka, et al.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each having the electrophotographic photosensitive member.

Description of the Related Art

A phthalocyanine pigment having high sensitivity is often used as a charge generating material used for an electrophotographic photosensitive member.

However, an electrophotographic photosensitive member using a phthalocyanine pigment has excellent sensitivity characteristics, but a problem thereof is that generated photo carriers tend to remain in a photosensitive layer and cause potential variation such as ghost memory.

Japanese Patent Application Laid-Open No. H06-214414 describes a technique of incorporating a phthalocyanine pigment and an organic acid into a photosensitive layer. Japanese Patent Application Laid-Open No. 2011-175088 describes a technique on a new gallium phthalocyanine compound. Japanese Patent Application Laid-Open No. 2013-28699 describes a technique of a composite pigment including a hydroxygallium phthalocyanine compound obtained from the gallium phthalocyanine compound described in Japanese Patent Application Laid-Open No. 2011-175088 and an azo pigment.

However, as a result of investigation by the present inventors, sensitivity and a ghost phenomenon may not be able to be sufficiently improved by the techniques described in Japanese Patent Application Laid-Open No. H06-214414 and Japanese Patent Application Laid-Open No. 2011-175088, and there was room for improvement.

SUMMARY OF THE INVENTION

Then, one embodiment of the present invention is directed to providing an electrophotographic photosensitive member having high sensitivity and suppressed in ghost memory, and a process cartridge and an electrophotographic apparatus each having the electrophotographic photosensitive member.

According to one aspect of the present invention, there is provided an electrophotographic photosensitive member including: a support; and a photosensitive layer on the support; wherein the photosensitive layer includes a gallium phthalocyanine crystal and an arene compound, the content of the arene compound in the photosensitive layer is 0.2% by mass or more and 20% by mass or less based on the gallium phthalocyanine crystal, and the arene compound has: a halogen atom or a halogen-substituted alkyl group, and a sulfonic acid group or a sulfonic acid salt group, as a substituent.

According to another aspect of the present invention, there is provided a process cartridge, integrally supporting the above electrophotographic photosensitive member and at least one unit selected from the group consisting of a charging unit, a developing unit, a transfer unit and a cleaning unit; and detachably attachable to a main body of an electrophotographic apparatus.

According to further aspect of the present invention, there is provided an electrophotographic apparatus including the above electrophotographic photosensitive member, a charging unit, an exposing unit, a developing unit and a transfer unit.

The present invention can provide an electrophotographic photosensitive member having high sensitivity and suppressed in ghost memory, and a process cartridge and an electrophotographic apparatus each having the electrophotographic photosensitive member.

Further features of the present invention will become apparent from the following description of exemplary embodiments with reference to the attached drawings.

DESCRIPTION OF THE EMBODIMENTS

Figure 1:
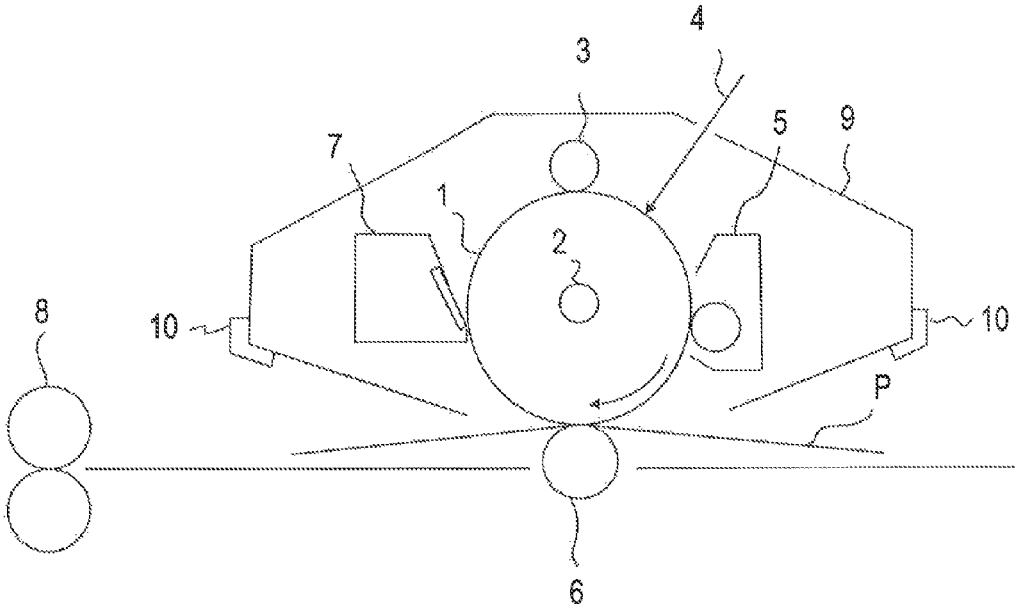
FIG. 1 is a diagram illustrating an example of the schematic structure of an electrophotographic apparatus provided with a process cartridge having the electrophotographic photosensitive member of the present invention.

Preferred Embodiments of the Present Invention will now be described in detail in accordance with the accompanying drawings.

In the present invention, the photosensitive layer of the electrophotographic photosensitive member includes a gallium phthalocyanine crystal and an arene compound, and the content of the arene compound is 0.2% by mass or more and 20% by mass or less based on the gallium phthalocyanine crystal.

Further, the arene compound has a halogen atom or a halogen-substituted alkyl group, and a sulfonic acid group or a sulfonic acid salt group, as a substituent.

The above arene compound can be a compound represented by the following formula (1).

$$(X)_n Ar(Y)_m \quad (1)$$

In formula (1), Ar represents a group derived by removing m+n hydrogen atoms from substituted or unsubstituted benzene, or a group derived by removing m+n hydrogen atoms from substituted or unsubstituted naphthalene. Examples of the substituent of the substituted benzene and the substituent of the substituted naphthalene include an amino group, a hydroxy group and an alkyl group having 1 to 2 carbon atoms. X represents a halogen atom or a halogen-substituted alkyl group having 1 to 3 carbon atoms. Y represents a sulfonic acid group or a sulfonic acid salt group. n represents an integer of 1 to 4. m represents an integer of 1 to 3. Examples of the sulfonic acid salt group include $—SO_3Na$ and $—SO_3K$.

Further, Y in the formula (1) is more preferably a sulfonic acid group, and n is more preferably an integer of 2 to 3.

Specific examples (illustrated compounds) of the arene compound represented by the above formula (1) will be shown below, but the present invention is not limited to these compounds.

(1-1)
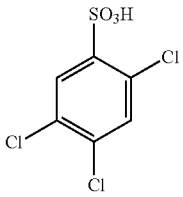
(1-2)
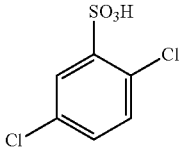
(1-3)
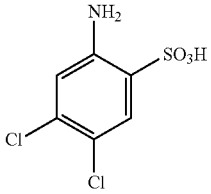
(1-4)
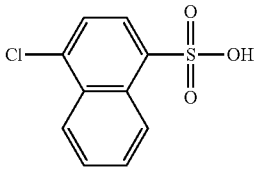
(1-5)
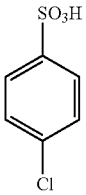
(1-6)
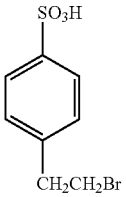
(1-7)
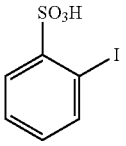
(1-8)
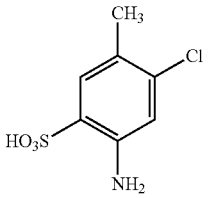
-continued
(1-9)
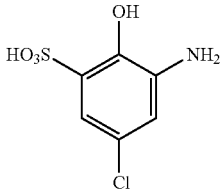
(1-10)
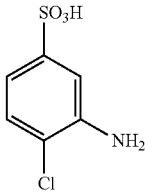
(1-11)
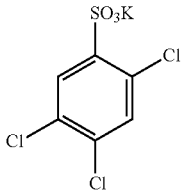
(1-12)
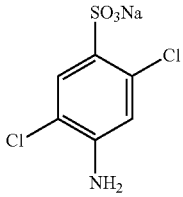
(1-13)
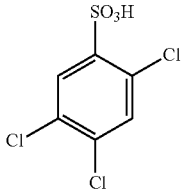
(1-14)
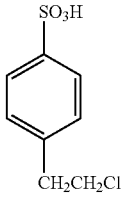
(1-15)
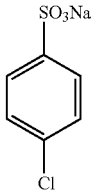
(1-16)
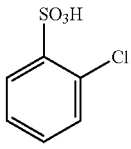

-continued
(1-17)
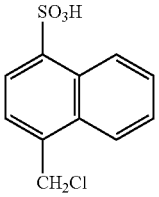
(1-18)
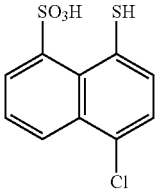
(1-19)
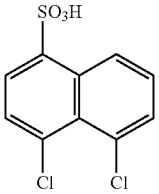
(1-20)
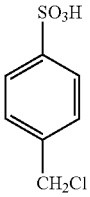
(1-21)
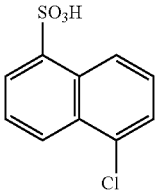
(1-22)
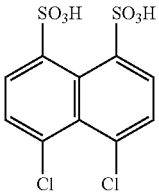
(1-23)
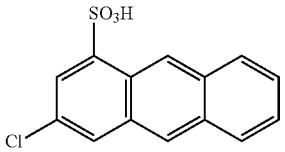
(1-24)
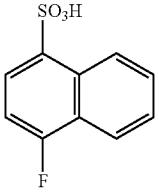
-continued
(1-25)
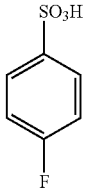
(1-26)
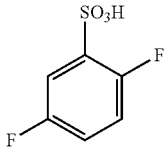
(1-27)
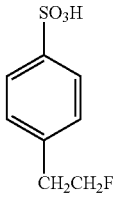
(1-28)
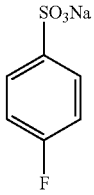
(1-29)
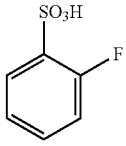
(1-30)
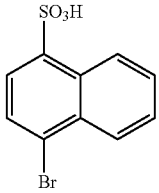
(1-31)
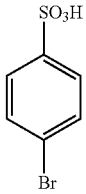
(1-32)
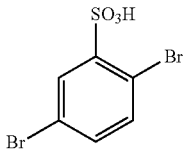

-continued (1-33)

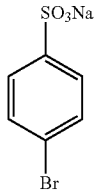

(1-34)

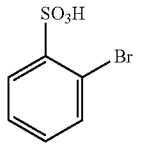

(1-35)

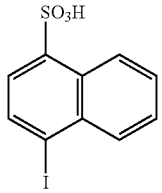

(1-36)

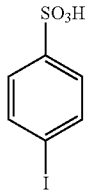

(1-37)

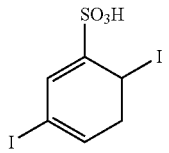

(1-38)

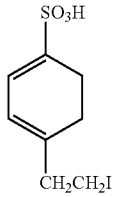

(1-39)

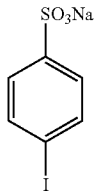

The present inventors have found that an arene compound having electron-withdrawing substituents of both a halogen group and a sulfonic acid group or a sulfonic acid salt group improves the carrier generation efficiency and the ghost memory of a gallium phthalocyanine crystal. The arene compound having a halogen group and a sulfonic acid group or a sulfonic acid salt group probably works to bring distortion to spatial broadening of the electron orbit in the molecule by the electron-withdrawing groups in the compound to withdraw remaining carriers in the gallium phthalocyanine crystal.

The gallium phthalocyanine crystal is formed of gallium phthalocyanine molecules, and these molecules may have an axial ligand and/or a substituent. Among the axial ligand, a hydroxy group and a chloro group are preferred because the hydroxy group and the chloro group have particularly high sensitivity but easily generate ghost memory, and therefore, the present invention effectively acts.

Further, among the gallium phthalocyanine crystal, a hydroxygallium phthalocyanine crystal having peaks at a Bragg angle 2θ±0.2° of 7.4° and 28.3° in CuKα characteristic X-ray diffraction is preferred. Among the chlorogallium phthalocyanine crystal, a chlorogallium phthalocyanine crystal having peaks at a Bragg angle 2θ±0.2° of 7.4°, 16.6°, 25.5° and 28.0° in CuKα characteristic X-ray diffractionis preferred.

Among these gallium phthalocyanine crystals, a hydroxygallium phthalocyanine crystal having peaks at a Bragg angle 2θ±0.2° of 7.4° and 28.3° in CuKα characteristic X-ray diffraction is particularly preferred.

The content of the arene compound in a photosensitive layer is preferably 0.2% by mass or more and 20% by mass or less, more preferably 3% by mass or more and 10% by mass or less based on the gallium phthalocyanine crystal.

The arene compound may be used in combination.

The electrophotographic photosensitive member of the present invention includes a support and a photosensitive layer. The photosensitive layer may be a monolayer type photosensitive layer containing a charge transport material and a charge generating material in the same layer or may be a lamination type (function separation type) photosensitive layer which is separated into a charge generating layer containing a charge generating material and a charge transport layer containing a charge transport material. The lamination type photosensitive layer is preferred from the point of view of electrophotographic characteristics. Further, among the lamination type photosensitive layer, a lamination type photosensitive layer having a charge generating layer and a charge transport layer formed on the charge generating layer is preferred from the point of view of electrophotographic characteristics.

The support can be a support having conductivity (conductive support), and examples of the conductive support include a support made of a metal (alloy) such as aluminum and stainless steel and a support made of a metal, plastics, paper and the like each having a conductive film on the surface thereof.

Further, examples of the shape of the support include a cylindrical shape and a film form.

An undercoat layer (also referred to as an intermediate layer) having a barrier function or an adhesive function can also be provided between the support and the photosensitive layer.

The undercoat layer can be formed by coating a support or a conductive layer to be described below with a coating liquid for undercoat layers prepared by dissolving a resin in a solvent and drying the resulting coating film.

Examples of the resin used for the undercoat layer include polyvinyl alcohol, polyethylene oxide, ethylcellulose, methylcellulose, casein, polyamide, glue and gelatin.

The thickness of the undercoat layers can be 0.3 to 5.0 μm.

Further, a conductive layer for the purpose of hiding unevenness and defects on the surface of a support, suppressing interference fringes and the like may be provided between a support and an undercoat layer or a photosensitive layer.

The conductive layer can be formed by coating a support with a coating liquid for conductive layers prepared by dispersing conductive particles, such as carbon black, metal particles and metal oxide particles, in a solvent together with a binder resin and drying/curing the resulting coating film.

The thickness of the conductive layer is preferably 5 to 40 μm, more preferably 10 to 30 μm.

When the photosensitive layer is a lamination type photosensitive layer, a charge generating layer can be formed by first applying a coating liquid for charge generating layers prepared by dispersing a phthalocyanine pigment, a binder resin and the arene compound of the present invention in a solvent to form a coating film and then drying the resulting coating film. The coating liquid for charge generating layers may also be prepared by first preparing a dispersion by dispersing a phthalocyanine pigment as a charge generating material and a binder resin in a solvent and then adding the arene compound of the present invention to the resulting dispersion.

The thickness of the charge generating layer is preferably 0.05 to 1 μm, more preferably 0.1 to 0.3 μm.

As described above, the arene compound of the present invention can be incorporated into a photosensitive layer (charge generating layer).

When the arene compound of the present invention is incorporated into the charge generating layer, the content of the arene compound of the present invention in the charge generating layer is preferably 0.2% by mass or more and 20% by mass or less, more preferably 3% by mass or more and 10% by mass or less based on a gallium phthalocyanine crystal which is a charge generating material.

The content of the charge generating material in the charge generating layer is preferably from 30% by mass to 90% by mass, more preferably from 50% by mass to 80% by mass based on the total mass of the charge generating layer.

As the charge generating material used for the charge generating layer, a gallium phthalocyanine crystal and a material other than the gallium phthalocyanine crystal (for example, azo pigment) may be used in combination. In this case, the content of the gallium phthalocyanine crystal can be 50% by mass or more based on the total mass of the charge generating material.

Examples of the binder resin used for the charge generating layer include resins such as polyester, an acrylic resin, a phenoxy resin, polycarbonate, polyvinyl butyral, polystyrene, polyvinyl acetate, polysulfone, polyarylate, vinylidene chloride, an acrylonitrile copolymer and polyvinyl benzal. Among these resins, polyvinyl butyral and polyvinyl benzal are preferred.

When the photosensitive layer is a lamination type photosensitive layer, a charge transport layer can be formed by applying a coating liquid for charge transport layers prepared by dissolving a charge transport material and a binder resin in a solvent and drying the resulting coating film.

The thickness of the charge transport layer is preferably 5 to 40 μm, more preferably 10 to 25 μm.

The content of the charge transport material in the charge transport layer is preferably 20 to 80% by mass, more preferably 30 to 60% by mass based on the total mass of the charge transport layer.

Examples of the charge transport material include a triarylamine compound, a hydrazone compound, a stilbene compound, a pyrazoline compound, an oxazole compound, a thiazole compound and a triarylmethane compound. Among these compounds, a triarylamine compound is preferred.

Examples of the binder resin used for the charge transport layer include polyester, an acrylic resin, a phenoxy resin, polycarbonate, polystyrene, polyvinyl acetate, polysulfone, polyarylate, vinylidene chloride and an acrylonitrile copolymer. Among these resins, polycarbonate and polyarylate are preferred.

When the photosensitive layer is a monolayer type photosensitive layer, the monolayer type photosensitive layer is formed as follows. That is, the monolayer type photosensitive layer can be formed by applying a coating liquid for monolayer type photosensitive layers prepared by dispersing a gallium phthalocyanine crystal, a charge transport material, a binder resin and the arene compound of the present invention in a solvent and drying the resulting coating film.

Further, the arene compound of the present invention may be contained in the gallium phthalocyanine crystal.

A method for producing the gallium phthalocyanine crystal in which the arene compound is contained of the present invention will be described.

The gallium phthalocyanine crystal in which the arene compound is contained of the present inventions is obtained by a crystal transformation step of adding the arene compound of the present invention to gallium phthalocyanine followed by milling treatment to thereby perform crystal transformation of gallium phthalocyanine. The gallium phthalocyanine used for milling treatment can be a gallium phthalocyanine crystal obtained by an acid pasting method.

The milling treatment performed here is, for example, a treatment performed using a milling apparatus such as a sand mill and a ball mill together with a dispersing agent such as glass beads, steel beads and alumina balls. The milling time can be about 1 to 200 hours. A particularly preferred method includes taking a sample every 5 to 10 hours and observing the Bragg angle of a crystal. The amount of the dispersing agent used in the milling treatment can be 10 to 50 times the gallium phthalocyanine crystal on the mass basis. Further, examples of the solvent used include amide-based solvents such as N,N-dimethylformamide, N,N-dimethylacetamide, N-methylformamide, N-methylacetamide, N-methylpropionamide and N-methyl-2-pyrrolidone; halogen-based solvents such as chloroform; ether-based solvents such as tetrahydrofuran; and sulfoxide-based solvents such as dimethyl sulfoxide. The amount of the solvent used can be 5 to 30 times the gallium phthalocyanine crystal on the mass basis. The amount of the arene compound of the present invention used can be 0.02 to 2 times the gallium phthalocyanine crystal on the mass basis.

In the present invention, whether the gallium phthalocyanine crystal contains the arene compound in itself of the present invention is determined by analyzing the H-NMR measurement data of the resulting gallium phthalocyanine crystal.

For example, when the arene compound of the present invention is subjected to milling treatment with a solvent which can dissolve the arene compound or a washing step after the milling treatment, the resulting gallium phthalocyanine crystal is subjected to H-NMR measurement. When the arene compound of the present invention is detected, it can be determined that the arene compound of the present invention is contained in the crystal.

[H-NMR Measurement]

Measuring instrument used: AVANCEIII 500, manufactured by BRUKER Corporation

Solvent: Deuterated sulfuric acid ($D_2SO_4$)

A protective layer may be provided on a photosensitive layer for the purpose of protecting the photosensitive layer.

The protective layer can be formed by coating the photosensitive layer with a coating liquid for protective layers prepared by dissolving a resin in a solvent and drying/curing the resulting coating film. When the coating film is cured, the coating film can be cured by heating, electron beams, ultraviolet rays or the like. Examples of preferred resins include polyvinyl butyral, polyester, polycarbonate, nylon, polyimide, polyarylate, polyurethane, a styrene-butadiene copolymer, a styrene-acrylic acid copolymer and a styrene-acrylonitrile copolymer.

The thickness of the protective layer can be 0.05 to 20 μm.

Examples of the coating method of the coating liquid for each layer include a dip coating method (dipping method), a spray coating method, a spinner coating method, a bead coating method, a blade coating method and a beam coating method.

Further, a layer serving as the surface layer of an electrophotographic photosensitive member may contain conductive particles, an ultraviolet absorber and lubricating particles such as fluorine atom-containing resin particles. Examples of the conductive particles include metal oxide particles such as tin oxide particles.

FIG. 1 is a diagram illustrating an example of the schematic structure of an electrophotographic apparatus provided with a process cartridge having the electrophotographic photosensitive member of the present invention.

Reference numeral 1 denotes an electrophotographic photosensitive member having a cylindrical shape (drum shape), and is rotated about a shaft 2 at a predetermined peripheral speed (process speed) in the arrow direction.

The surface (peripheral surface) of the electrophotographic photosensitive member 1 is charged to a predetermined positive or negative potential by a charging unit (primary charging unit) 3 in the course of rotation. Next, the surface of the electrophotographic photosensitive member 1 is irradiated with exposure light (image exposure light) 4 from an exposing unit (image exposing unit) (not illustrated) to form an electrostatic latent image corresponding to target image information on the surface of the electrophotographic photosensitive member 1. The exposure light 4 is intensity-modulated light corresponding to a time-series electric digital pixel signal of target image information output, for example, from an exposing unit including slit exposure and laser beam scanning exposure.

The electrostatic latent image formed on the surface of the electrophotographic photosensitive member 1 is developed (normal development or reversal development) with toner accommodated in a developing unit 5 to form a toner image on the surface of the electrophotographic photosensitive member 1. The toner image formed on the surface of the electrophotographic photosensitive member 1 is transferred to a transfer material P by a transfer unit 6. At this time, a voltage of reverse polarity with respect to the charge held by toner is applied to the transfer unit 6 from a power supply (not illustrated). Further, when the transfer material P is paper, the transfer material P is taken out from a paper feed section (not illustrated) and fed between the electrophotographic photosensitive member 1 and the transfer unit 6 in synchronization with the rotation of the electrophotographic photosensitive member 1.

The transfer material P to which the toner image has been transferred from the electrophotographic photosensitive member 1 is separated from the surface of the electrophotographic photosensitive member 1, conveyed to a fixing unit 8 to be subjected to fixing treatment of the toner image, and thereby printed out as an image-formed matter (a print, a copy) to the outside of the electrophotographic apparatus.

The surface of the electrophotographic photosensitive member 1 after transferring the toner image to the transfer material P is cleaned by removing a deposit such as toner (transfer residual toner) with a cleaning unit 7. In recent years, a cleanerless system has also been developed, and the transfer residual toner may also be able to be removed by a developing unit or the like. Further, the surface of the electrophotographic photosensitive member 1 is subjected to charge elimination treatment with pre-exposure light from a pre-exposing unit (not illustrated) and then repeatedly used for image formation. Note that when the charging unit 3 is a contact charging unit using a charged roller or the like, the pre-exposing unit is not necessarily required.

In the present invention, a plurality of components selected from the electrophotographic photosensitive member 1, the charging unit 3, the developing unit 5, the transfer unit 6, the cleaning unit 7 and the like as described above are received in a container and integrally supported to form a process cartridge. The process cartridge can be formed to be detachably attachable to the main body of the electrophotographic apparatus. For example, at least one unit selected from the group consisting of the charging unit 3, the developing unit 5 and the cleaning unit 7 is integrally supported with the electrophotographic photosensitive member 1 to form a cartridge. Then, the cartridge may be formed as a process cartridge 9 which is detachably attachable to the main body of the electrophotographic apparatus using a guide unit 10 such as a rail of the main body of the electrophotographic apparatus.

The exposure light 4 may be reflected light or transmitted light from a manuscript when the electrophotographic apparatus is a copying machine. Alternatively, the exposure light may be light emitted by the scanning of a laser beam, the drive of an LED array, the drive of a liquid crystal shutter array or the like, performed according to signals obtained by reading a manuscript with a sensor followed by coding.

The electrophotographic photosensitive member 1 of the present invention can be widely applied to a copying machine, a laser beam printer, a CRT printer, an LED printer, FAX, a liquid crystal printer, laser plate making and the like.

EXAMPLES

Hereinafter, the present invention will be described in more detail with respect to specific Examples. However, the present invention is not limited to these examples. Note that the thickness in Examples and Comparative Examples was determined by an eddy current type thicknessmeter (FISCHERSCOPE, manufactured by Fischer Instruments K.K.) or determined by converting mass per unit area to thickness using specific gravity. Note that "parts" in Examples means "parts by mass".

Crystal Production Example 1

Synthesis Step

In a nitrogen atmosphere, 36.7 parts of orthophthalonitrile, 25 parts of gallium trichloride and 300 parts of α-chloronaphthalene were allowed to react with each other at 200° C. for 5.5 hours, and the product was filtered at 130° C. The resulting product was subjected to dispersion washing with N,N-dimethylformamide at 140° C. for hours and then filtered. The product collected by filtration was washed with methanol and dried to obtain 46 parts of a chlorogallium phthalocyanine crystal.

Reprecipitation Step

Twenty four parts of the chlorogallium phthalocyanine crystal obtained in the synthesis step was dissolved in 750 parts of 5° C. concentrated sulfuric acid, and the resulting solution was dropwise added to 2500 parts of ice water with stirring to reprecipitate crystals. The mixture was filtered using a filter press (210 m/m filter press from Nihon Rokasochi Co., Ltd.). At this time, a polytetrafluoroethylene filter (Gore-Tex filter cloth, manufactured by Japan Gore-Tex, Inc.) having an amount of water permeated of 250 $dm^3/m^2/min$ was used as a filter. The liquid feed pressure was set to 4.5 $kgf/cm^2$. Subsequently, the resulting crystals were subjected to dispersion washing with a 2% ammonia solution for 30 minutes, then subjected to dispersion washing with ion-exchanged water 4 times, and finally freeze-dried to obtain a hydroxygallium phthalocyanine crystal in a yield of 97%.

Crystal Transformation Step

Zero point five part of the hydroxygallium phthalocyanine crystal obtained in the reprecipitation step and 9.5 parts of N,N-dimethylformamide were subjected to milling treatment in a ball mill together with 15 parts of glass beads each having a diameter of 1 mm at room temperature (23° C.) for 70 hours. A gallium phthalocyanine crystal was removed from the dispersion using N,N-dimethylformamide and filtered, and the top of the filter was sufficiently washed with tetrahydrofuran. The product collected by filtration was vacuum dried to obtain 0.43 part of a hydroxygallium phthalocyanine crystal.

Crystal Production Example 2

A hydroxygallium phthalocyanine crystal was produced in the same manner as in Crystal Production Example 1 except that, in Crystal Production Example 1, the crystal transformation step was changed as described below.

Crystal Transformation Step

Zero point five part of the hydroxygallium phthalocyanine crystal, 9.5 parts of N,N-dimethylformamide and 0.5 part of a compound represented by the illustrated compound (1-11) were subjected to milling treatment in a ball mill together with 15 parts of glass beads each having a diameter of 1 mm at room temperature (23° C.) for 70 hours. A gallium phthalocyanine crystal was removed from the dispersion using N,N-dimethylformamide and filtered, and the top of the filter was sufficiently washed with tetrahydrofuran. The product collected by filtration was vacuum dried to obtain 0.45 part of a hydroxygallium phthalocyanine crystal.

It was observed by H-NMR measurement that the hydroxygallium phthalocyanine crystal contained the compound represented by the illustrated compound (1-11) in an amount of 4.8% by mass in terms of the proton ratio.

Crystal Production Example 3

A hydroxygallium phthalocyanine crystal was produced in the same manner as in Crystal Production Example 1 except that, in Crystal Production Example 1, the synthesis step and the reprecipitation step were changed as described below.

Synthesis Step

Thirty parts of 1,3-diiminoisoindoline, 8 parts of gallium trichloride and 230 parts of dimethyl sulfoxide were allowed to react with each other at 150° C. for 12 hours to obtain 28 parts of a chlorogallium phthalocyanine crystal.

Reprecipitation Step

Ten parts of the resulting chlorogallium phthalocyanine crystal was sufficiently dissolved in 300 parts of sulfuric acid (at a concentration of 97%) heated to 60° C. The resulting solution was dropwise added to a mixed solution of 600 parts of 25% aqueous ammonia and 200 parts of ion-exchanged water to precipitate a hydroxygallium phthalocyanine crystal. The crystal was collected by filtration, washed with ion-exchanged water, and dried to obtain 8 parts of a hydroxygallium phthalocyanine crystal.

Crystal Production Example 4

To 1.24 parts of the chlorogallium phthalocyanine crystal obtained in the synthesis step of Crystal Production Example 3, 100 mL of dimethyl sulfoxide and 23 parts of p-chlorobenzene sulfonic acid hydrate were added, and the mixture was heated to 110° C. and allowed to react with each other for 9 hours. The reaction product was cooled to room temperature, and then a very small amount of insolubles was filtered and removed. About 150 mL of ion-exchanged water was added to the resulting solution, and the mixture was stirred at room temperature for 6 hours. The produced crystal was filtered, sufficiently washed with ion-exchanged water, and then dried to obtain 1.45 parts of a gallium phthalocyanine crystal made of a gallium phthalocyanine compound represented by the following formula (2-4).

(2-4)

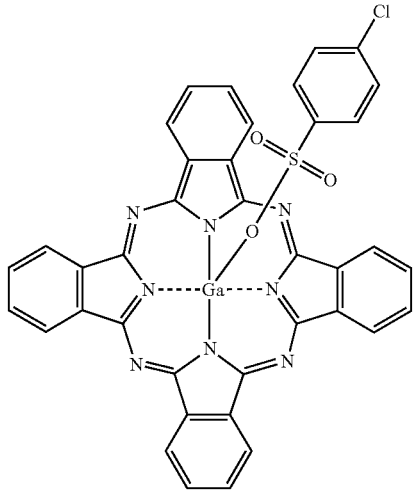

Example 1

An aluminum cylinder (JIS-A3003, aluminum alloy) having a diameter of 24 mm and a length of 257.5 mm was used as a support (conductive support).

Next, 60 parts of barium sulfate particles covered with tin oxide (trade name: Pastran PC1, manufactured by Mitsui Mining and Smelting Co., Ltd.), 15 parts of titanium oxide particles (trade name: TITANIX JR, manufactured by TAYCA Corp.), 43 parts of resol-type phenolic resin (trade name: Phenolite J-325, manufactured by DIC Corporation, solid content: 70% by mass), 0.015 part of silicone oil (trade name: SH28PA, manufactured by Dow Corning Toray Co., Ltd.), 3.6 parts of silicone resin particles (trade name: Tospal 120, manufactured by Toshiba Silicone Co., Ltd.), 50 parts of 2-methoxy-1-propanol and parts of methanol were charged into a ball mill and subjected to dispersion treatment for 20 hours to prepare a coating liquid for conductive layers. The coating liquid for conductive layers was applied to the support by dipping to form a coating film, and the resulting coating film was cured by heating at 140° C. for 1 hour to thereby form a conductive layer having a film thickness of 15 μm.

Next, 10 parts of copolymer nylon (trade name: Amilan CM8000, manufactured by Toray Industries, Inc.) and 30 parts of methoxymethylated 6-nylon (trade name: Trejin EF-30T, manufactured by Teikoku Chemical Industries Co., Ltd.) were dissolved in a mixed solvent of 400 parts of methanol and 200 parts of n-butanol to prepare a coating liquid for undercoat layers. The coating liquid for undercoat layers was applied to the conductive layer by dipping to form a coating film, and the resulting coating film was dried at 80° C. for 6 minutes to form an undercoat layer having a thickness of 0.45 μm.

Next, 10 parts of the hydroxygallium phthalocyanine crystal (charge generating material) obtained in Crystal Production Example 1, 5 parts of polyvinyl butyral (trade name: S-lec BX-1, manufactured by Sekisui Chemical Co., Ltd.) and 250 parts of cyclohexanone were charged into a sand mill using glass beads each having a diameter of 1 mm and subjected to dispersion treatment for 4 hours. Subsequently, 0.5 part of the illustrated compound (1-1) and 250 parts of ethyl acetate were added to the resulting dispersion to thereby prepare a coating liquid for charge generating layers. The coating liquid for charge generating layers was applied to the undercoat layer by dipping to form a coating film, and the resulting coating film was dried at 100° C. for 10 minutes to form a charge generating layer having a thickness of 0.14 μm.

Next, 40 parts of a compound represented by the following formula (C-1) (charge transport material (hole transporting compound)), (C-1)

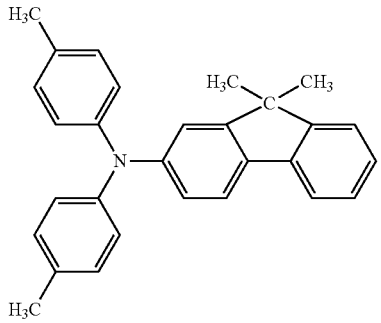

40 parts of a compound represented by the following formula (C-2) (charge transport material (hole transporting compound))

(C-2)

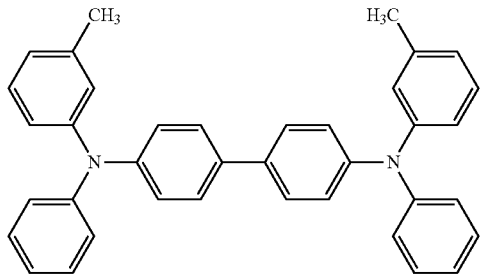

and 100 parts of polycarbonate (trade name: Iupilon 2200, manufactured by Mitsubishi Engineering Plastics Corporation) were dissolved in a mixed solvent of 600 parts of monochlorobenzene and 200 parts of dimethoxymethane to prepare a coating liquid for charge transport layers. The coating liquid for charge transport layers was applied to the charge generating layer by dipping to form a coating film, and the resulting coating film was dried at 120° C. for minutes to form a charge transport layer having a thickness of 15 μm.

In this way, an electrophotographic photosensitive member of Example 1 having a cylindrical shape (drum shape) was produced.

Examples 2 to 13 and 17 to 19

Electrophotographic photosensitive members were produced in the same manner as in Example 1 except that the type and the amount of the illustrated compound (1-1) added in Example 1 were changed as shown in Table 1.

Example 14

An electrophotographic photosensitive member was produced in the same manner as in Example 13 except that Crystal Production Example 1 in Example 13 was changed to Crystal Production Example 2.

Example 15

An electrophotographic photosensitive member was produced in the same manner as in Example 1 except that, in Example 1, the illustrated compound (1-1) was not added, but 0.5 part of the illustrated compound (1-11) was added before performing dispersion treatment in a sand mill, and then 250 parts of ethyl acetate was added to the mixture to prepare a coating liquid for charge generating layers.

Example 16

An electrophotographic photosensitive member was produced in the same manner as in Example 1 except that, in Example 1, Crystal Production Example 1 was changed to Crystal Production Example 3, and the illustrated compound (1-1) was changed to the illustrated compound (1-11).

Comparative Example 1

An electrophotographic photosensitive member was produced in the same manner as in Example 1 except that, in Example 1, Crystal Production Example 1 was changed to Crystal Production Example 3, and a coating liquid for charge generating layers was produced without adding the illustrated compound (1-1).

Comparative Examples 2 to 6

Electrophotographic photosensitive members were produced in the same manner as in Example 1 except that the type and the amount of the illustrated compound (1-1) added in Example 1 were changed as shown in Table 1. The structure of the illustrated compounds (2-1), (2-2), (2-3), (2-4) and (2-5) added in Comparative Examples 2 to 6, respectively, is shown below.

(2-2)

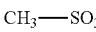

(2-1)

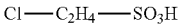

-continued (2-3)

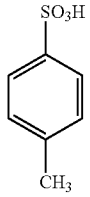

(2-4)

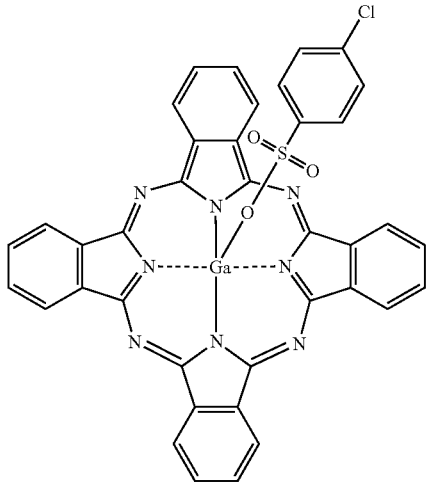

(2-5)

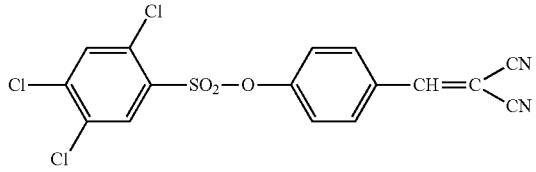

Evaluation of Examples 1 to 19 and Comparative Examples 1 to 6

The electrophotographic photosensitive members produced in each Example and each Comparative Example were used to evaluate sensitivity and ghost memory.

Figure 2:
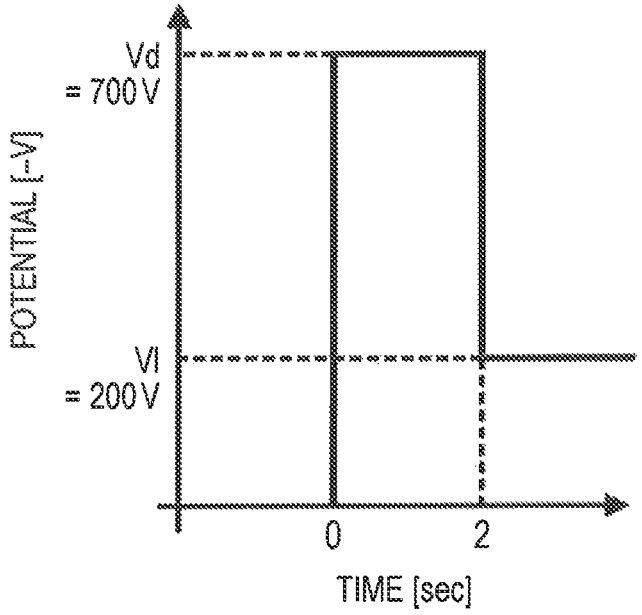
FIG. 2 is a diagram for the evaluation of the sensitivity of an electrophotographic photosensitive member.

With regard to sensitivity, the electrophotographic characteristics of the produced electrophotographic photosensitive members were measured with a direct voltage application-type electrophotographic photosensitive member measuring apparatus using curved NESA glass. Specifically, in order to remove the hysteresis of the electrophotographic photosensitive member (hysteresis of potential), the entire surface of the electrophotographic photosensitive member was first irradiated with light having a predetermined amount of light (1 ($\mu J/cm^2$)). Ten milliseconds after the irradiation, the surface of the electrophotographic photosensitive member was charged in a dark place so that the surface of the electrophotographic photosensitive member might have a predetermined potential (Vd: −700 V). In the state where the electrophotographic photosensitive member was placed in the dark place, the surface of the electrophotographic photosensitive member was exposed 2 seconds after charging so that the potential (Vl) after exposure of the surface of the electrophotographic photosensitive member might be −200 V, and the amount of light exposure at this time was evaluated as sensitivity. It is meant that the smaller the amount of light exposure, the higher the sensitivity of the electrophotographic photosensitive member. FIG. 2 illustrates the progression of potential on the surface of the electrophotographic photosensitive member in this evaluation.

Ghost memory was evaluated with a modified machine of a laser beam printer manufactured by Hewlett Packard Co. (trade name: LaserJet Pro400Color M451dn). The printer was modified so that the amount of exposure light (image exposure light) might be variable.

The electrophotographic photosensitive member produced was mounted on a process cartridge for cyan color, a development cartridge was removed from the apparatus, and thereto a potential measuring apparatus was inserted. The potential measuring apparatus was mounted on the station of the process cartridge for cyan color of the printer, and the amount of the exposure light was set so that light-area potential (Vl) might be −150 V. The potential measuring apparatus is formed by arranging a potential measuring probe at the developing position of the development cartridge, and the position of the potential measurement probe relative to the electrophotographic photosensitive member was set to the center in the drum shaft direction.

Then, the potential measuring apparatus was removed, the development cartridge was returned to the original state, and initial ghost image evaluation was performed.

Figure 3:
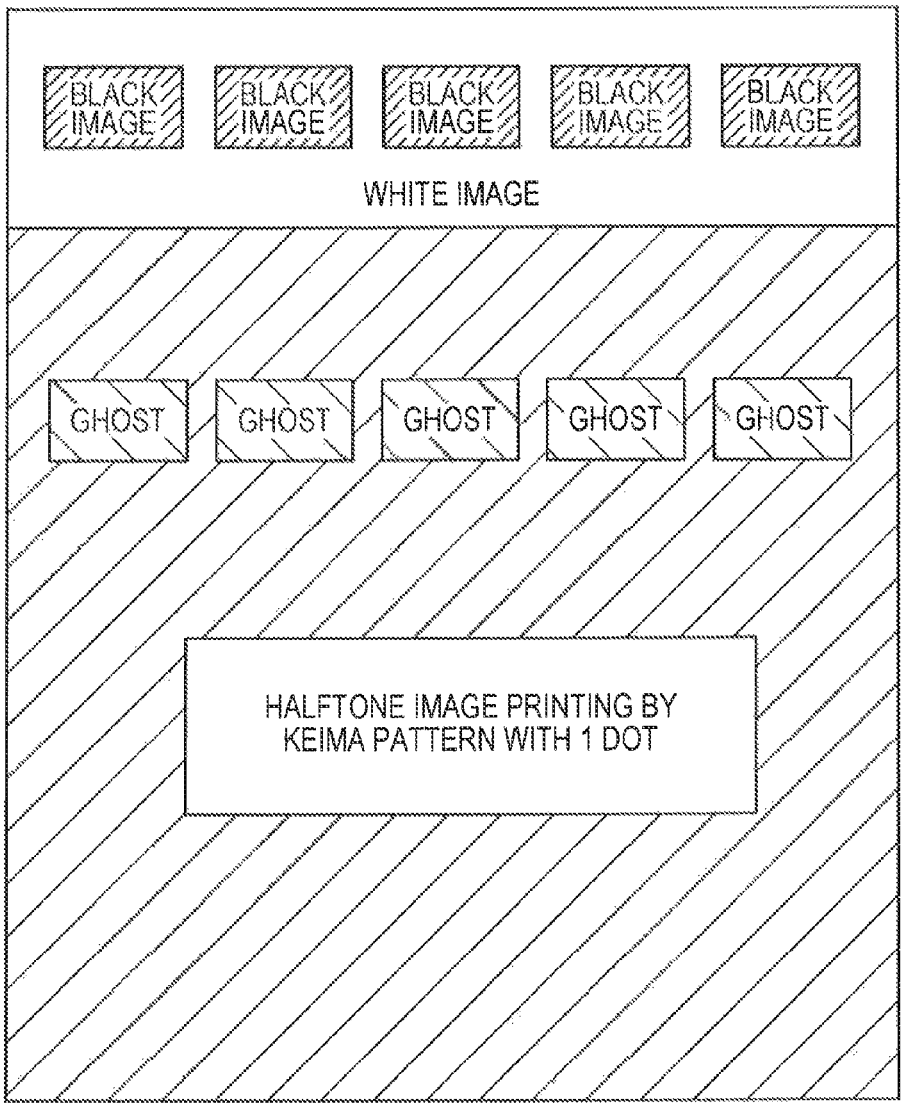
FIG. 3 is a diagram illustrating images for evaluation used in Examples.
Figure 4:
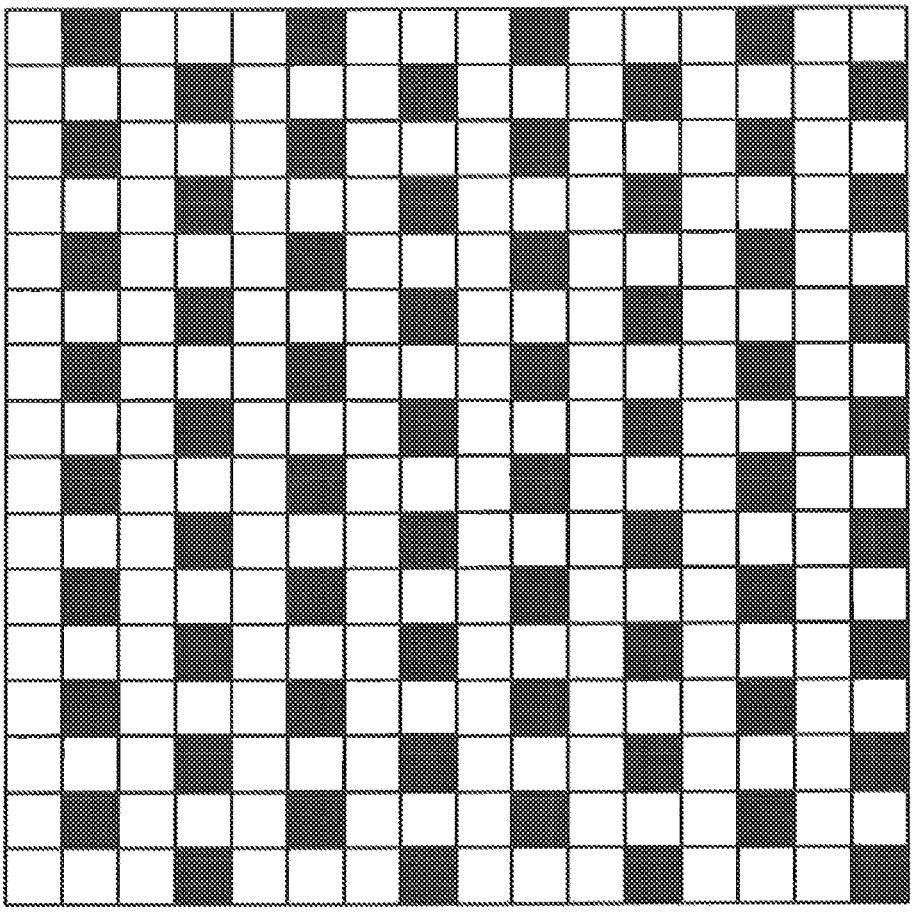
FIG. 4 is a diagram illustrating a 1-dot Keima pattern image for forming a halftone image.

As the images for evaluating ghost, square black images were output at the head part of the images, and then a halftone image was used, as illustrated in FIG. 3. The halftone image was printed by Keima pattern with 1 dot as illustrated in FIG. 4.

The ghost image was evaluated using a spectral densitometer (trade name: X-Rite504/508) manufactured by X-Rite Inc. Among the output images, the density of a portion which is not a ghost portion was subtracted from the density of a ghost portion, and the difference was defined as a ghost image density. This procedure was performed for 10 points in the output images of one sheet, and the average value of the 10 points was determined.

In this experiment, a ghost image density of 0.05 or more was defined as a level in which the effect of the present invention is not obtained, and a ghost image density of less than 0.05 was defined as a level in which the effect of the present invention is obtained.

The results are shown in Table 1.

TABLE 1

| | Gallium phthalocyanine crystal | Illustrated compound added | Content (wt % based on gallium phthalocyanine) | Addition step | Sensitivity | Ghost rank |
|---|---|---|---|---|---|---|
| Example 1 | Crystal Production Example 1 | (1-1) | 5 | Step after dispersion | 0.20 | 0.00 |
| Example 2 | Crystal Production Example 1 | (1-1) | 3 | Step after dispersion | 0.21 | 0.00 |
| Example 3 | Crystal Production Example 1 | (1-1) | 10 | Step after dispersion | 0.22 | 0.00 |

TABLE 1-continued

| | Gallium phthalocyanine crystal | Illustrated compound added | Content (wt % based on gallium phthalocyanine) | Addition step | Sensitivity | Ghost rank |
|---|---|---|---|---|---|---|
| Example 4 | Crystal Production Example 1 | (1-2) | 5 | Step after dispersion | 0.21 | 0.01 |
| Example 5 | Crystal Production Example 1 | (1-3) | 5 | Step after dispersion | 0.22 | 0.01 |
| Example 6 | Crystal Production Example 1 | (1-4) | 5 | Step after dispersion | 0.24 | 0.01 |
| Example 7 | Crystal Production Example 1 | (1-5) | 5 | Step after dispersion | 0.23 | 0.02 |
| Example 8 | Crystal Production Example 1 | (1-6) | 5 | Step after dispersion | 0.25 | 0.01 |
| Example 9 | Crystal Production Example 1 | (1-7) | 5 | Step after dispersion | 0.26 | 0.01 |
| Example 10 | Crystal Production Example 1 | (1-8) | 5 | Step after dispersion | 0.25 | 0.02 |
| Example 11 | Crystal Production Example 1 | (1-9) | 5 | Step after dispersion | 0.26 | 0.02 |
| Example 12 | Crystal Production Example 1 | (1-10) | 5 | Step after dispersion | 0.25 | 0.02 |
| Example 13 | Crystal Production Example 1 | (1-11) | 5 | Step after dispersion | 0.25 | 0.03 |
| Example 14 | Crystal Production Example 2 | (1-11) | 4.8 | Transformation step | 0.26 | 0.03 |
| Example 15 | Crystal Production Example 1 | (1-11) | 5 | Step before dispersion | 0.25 | 0.03 |
| Example 16 | Crystal Production Example 3 | (1-11) | 5 | Step after dispersion | 0.26 | 0.03 |
| Example 17 | Crystal Production Example 1 | (1-12) | 5 | Step after dispersion | 0.26 | 0.03 |
| Example 18 | Crystal Production Example 1 | (1-1) | 0.2 | Step after dispersion | 0.27 | 0.03 |
| Example 19 | Crystal Production Example 1 | (1-1) | 20 | Step after dispersion | 0.28 | 0.03 |
| Comparative Example 1 | Crystal Production Example 3 | — | 0 | Step after dispersion | 0.30 | 0.05 |
| Comparative Example 2 | Crystal Production Example 1 | (2-1) | 5 | Step after dispersion | 0.33 | 0.06 |
| Comparative Example 3 | Crystal Production Example 1 | (2-2) | 5 | Step after dispersion | 0.31 | 0.05 |
| Comparative Example 4 | Crystal Production Example 1 | (2-3) | 5 | Step after dispersion | 0.30 | 0.06 |
| Comparative Example 5 | Crystal Production Example 1 | (2-4) | 5 | Step after dispersion | 0.32 | 0.07 |
| Comparative Example 6 | Crystal Production Example 1 | (2-5) | 5 | Step after dispersion | 0.32 | 0.06 |

In Example 1, Example 7, Comparative Example 1 and Comparative Example 5, the particle size of the charge generating materials in the coating liquids for charge generating layers was measured, and image evaluation was performed using the electrophotographic photosensitive members produced.

<Particle Size Measurement>

The particle size of the charge generating material in the coating liquid for charge generating layers was measured with a centrifugal sedimentation type particle size distribution measuring apparatus CAPA-700 (manufactured by Horiba, Ltd.). The results are shown in Table 2.

TABLE 2

| | Particle size (μm) |
|---|---|
| Example 1 | 0.25 |
| Example 7 | 0.24 |
| Comparative Example 1 | 0.25 |
| Comparative Example 5 | 0.26 |

<Image Evaluation>

Images were output with a modified machine of a laser beam printer manufactured by Hewlett Packard Co. (trade name: LaserJet Pro400Color M451dn). The printer was modified so that the amount of exposure light (image exposure light) might be variable. The image evaluation was performed as follows: The test charts No. 5-2 issued by the Imaging Society of Japan were output before and after printing 40,000 sheets of images and evaluated for image density, resolution and reproducibility of color in the following manner. The results are shown in Table 3.

Further, the image evaluation was performed in the same manner as described above using the applied voltage of the charging unit by which the charge potential of the unexposed part may be −500 V before the printing test. The results are shown in Table 4.

<Image Density>

The test charts No. 5-2 issued by the Imaging Society of Japan were output before and after printing 40,000 sheets of images and measured for image density with a reflection densitometer manufactured by Macbeth Co. Ltd. (modified so that the density can be measured to three digits after the decimal point), and the difference between the image density before printing and the image density after printing was evaluated.

<Resolution>

The test charts No. 5-2 issued by the Imaging Society of Japan were output before and after printing 40,000 sheets of images and observed for a dot formation state (a dot scattered state and dot reproducibility) of the halftone part to thereby evaluate resolution according to the following criteria.

[Evaluation Criteria]

A: Very good without dot scattering.

B: Good with slight dot scattering.

C: Dot scattering and dot broadening are observed.

D: Dot scattering and dot broadening are greatly observed.

<Reproducibility of Color>

The test charts No. 5-2 issued by the Imaging Society of Japan were output before and after printing 40,000 sheets of images and measured for the chromaticness indices a* and b* in the L*a*b* color system (CIE: 1976) using a colorimeter (X-Rite938, manufactured by X-Rite Inc.). Then, the value of chroma C* represented by the following formula was determined to evaluate color reproducibility.

$$\text{Chroma } C^* = [(a^*)2 + (b^*)2]1/2$$

TABLE 3

| | Normal temperature and humidity | | | High temperature and humidity | | | Low temperature and humidity | | |
|---|---|---|---|---|---|---|---|---|---|
| | Density | Resolution | Color | Density | Resolution | Color | Density | Resolution | Color |
| Example 1 | 0.05 | A | 91 | 0.08 | A | 85 | 0.07 | A | 87 |
| Example 7 | 0.06 | A | 86 | 0.08 | A | 81 | 0.06 | A | 82 |
| Comparative Example 1 | 0.04 | A | 89 | 0.09 | A | 80 | 0.08 | A | 88 |
| Comparative Example 5 | 0.07 | A | 82 | 0.11 | B | 75 | 0.10 | B | 79 |

TABLE 4

| | Normal temperature and humidity | | | High temperature and humidity | | | Low temperature and humidity | | |
|---|---|---|---|---|---|---|---|---|---|
| | Density | Resolution | Color | Density | Resolution | Color | Density | Resolution | Color |
| Example 1 | 0.07 | A | 86 | 0.09 | A | 79 | 0.09 | A | 84 |
| Example 7 | 0.08 | A | 80 | 0.10 | A | 80 | 0.08 | A | 79 |
| Comparative Example 1 | 0.06 | A | 81 | 0.07 | A | 76 | 0.09 | A | 82 |
| Comparative Example 5 | 0.09 | B | 73 | 0.13 | B | 71 | 0.12 | B | 74 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-091821, filed Apr. 25, 2014 which is hereby incorporated by reference herein in its entirety.

What is claimed is:

1. An electrophotographic photosensitive member comprising:

a support; and a photosensitive layer on the support, the photosensitive layer comprising a gallium phthalocyanine crystal and an arene compound substituted with (i) a halogen atom or a halogen-substituted alkyl group, and (ii) a sulfonic acid group or a sulfonic acid salt group, wherein the content of the arene compound in the photosensitive layer is 0.2% to 20% by mass based on the gallium phthalocyanine crystal in the photosensitive layer.

2. The electrophotographic photosensitive member according to claim 1, wherein the arene compound is a compound represented by the following formula (1):

$$(X\text{-})_n Ar(\text{-}Y)_m \quad (1)$$

wherein Ar represents a group derived by removing m+n hydrogen atoms from substituted or unsubstituted benzene, or a group derived by removing m+n hydrogen atoms from substituted or unsubstituted naphthalene;

a substituent of the substituted benzene and a substituent of the substituted naphthalene are each an amino group, a hydroxy group or an alkyl group having 1 to 2 carbon atoms;

X represents a halogen atom or a halogen-substituted alkyl group having 1 to 3 carbon atoms;

Y represents a sulfonic acid group or a sulfonic acid salt group;

n represents an integer of 1 to 4; and m represents an integer of 1 to 3.

3. The electrophotographic photosensitive member according to claim 2, wherein Y is a sulfonic acid group.

4. The electrophotographic photosensitive member according to claim 2, wherein n is an integer of 2 to 3.

5. The electrophotographic photosensitive member according to claim 1, wherein the photosensitive layer comprises a charge generating layer and a charge transport layer formed on the charge generating layer, and the charge generating layer comprises the gallium phthalocyanine crystal and the arene compound.

6. The electrophotographic photosensitive member according to claim 1, wherein the content of the arene compound in the photosensitive layer is from 3% by mass to 10% by mass based on the gallium phthalocyanine crystal.

7. The electrophotographic photosensitive member according to claim 1, wherein the gallium phthalocyanine crystal is a hydroxygallium phthalocyanine crystal having peaks at a Bragg angle 2θ±0.2° of 7.4° and 28.3° in CuKα characteristic X-ray diffraction.

8. A process cartridge, integrally supporting the electrophotographic photosensitive member according to claim 1 and at least one unit selected from the group consisting of a charging unit, a developing unit, a transfer unit and a cleaning unit; and detachably attachable to a main body of an electrophotographic apparatus.

9. An electrophotographic apparatus comprising the electrophotographic photosensitive member according to claim 1, a charging unit, an exposing unit, a developing unit and a transfer unit.

10. The electrophotographic photosensitive member according to claim 1, wherein the arene compound comprises at least one compound among (1-1) to (1-39)

(1-1)

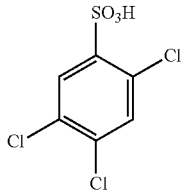

(1-2)

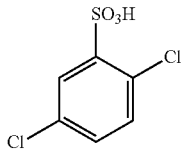

(1-3)

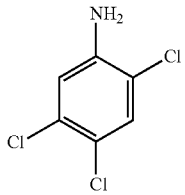

(1-4)

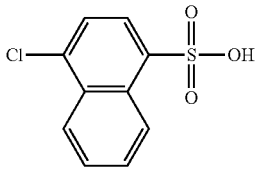

(1-5)

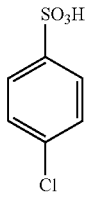

(1-6)

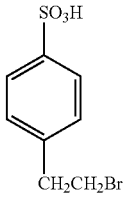

-continued (1-7)

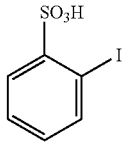

(1-8)

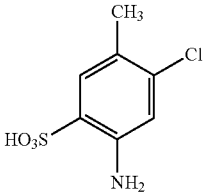

(1-9)

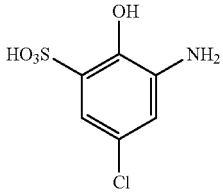

(1-10)

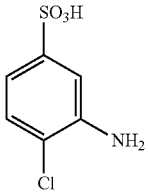

(1-11)

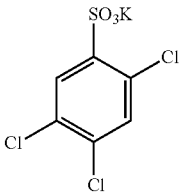

(1-12)

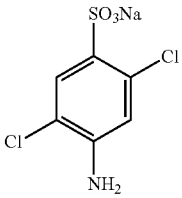

(1-13)

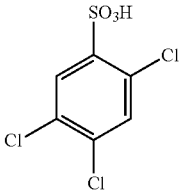

(1-14)

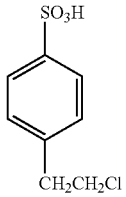

-continued
(1-15)
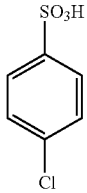
(1-16)
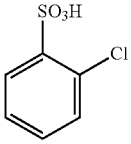
(1-17)
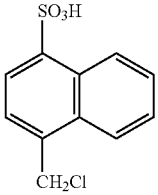
(1-18)
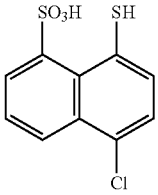
(1-19)
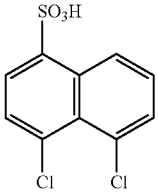
(1-20)
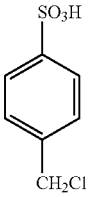
(1-21)
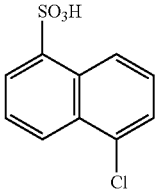
(1-22)
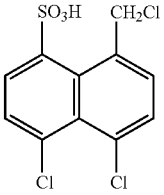
-continued
(1-23)
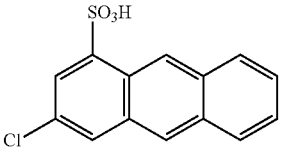
(1-24)
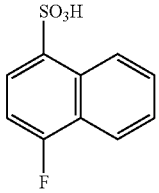
(1-25)
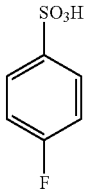
(1-26)
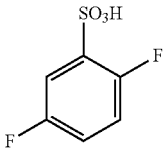
(1-27)
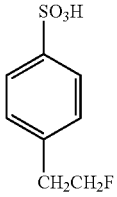
(1-28)
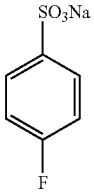
(1-29)
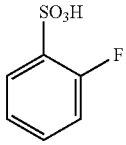
(1-30)
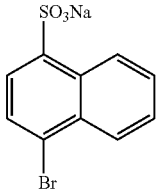

-continued
(1-31)
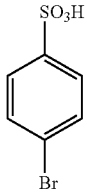
(1-32)
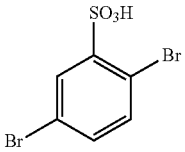
(1-33)
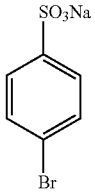
(1-34)
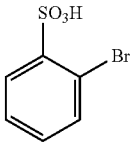
(1-35)
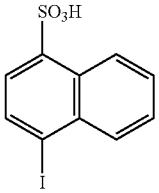
-continued
(1-36)
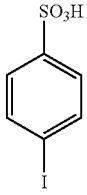
(1-37)
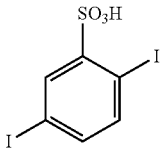
(1-38)
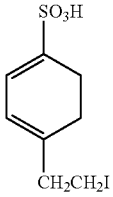
(1-39)
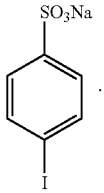
* * * * *